US005708981A

United States Patent [19]

Tilton

[11] Patent Number: 5,708,981

[45] Date of Patent: Jan. 20, 1998

[54] BOWLER'S WRIST BRACE

[76] Inventor: James Tilton, 38448 20th St., E., Palmdale, Calif. 93550

[21] Appl. No.: 800,449

[22] Filed: Feb. 18, 1997

[51] Int. Cl.[6] ..... A41D 13/08

[52] U.S. Cl. ..... 2/170; 2/161.1; 602/21

[58] Field of Search ..... 2/170, 162, 163, 2/166, 159, 161.1, 161.4; 602/21, 22

[56] References Cited

U.S. PATENT DOCUMENTS

| | | | |
|---|---|---|---|
| Re. 32,566 | 12/1987 | Patton, Jr. | 2/16 |
| 4,013,070 | 3/1977 | Harroff | 602/21 |
| 4,854,309 | 8/1989 | Elsey | 602/21 |
| 5,014,689 | 5/1991 | Meunchen et al. | 2/170 |
| 5,445,566 | 8/1995 | Hayes | 2/170 |
| 5,513,657 | 5/1996 | Nelson | 602/21 |

*Primary Examiner*—Gloria Hale

*Attorney, Agent, or Firm*—Roger A. Marrs

[57] ABSTRACT

A wrist and hand support for bowlers, including an elongated cushioned base supporting an elongated laterally or transverseley flexible brace member against the back of the hand and wrist of the bowler, is disclosed. Straps having hook and pile fasteners releasably retain the brace member in position and retains the cushioned base on the bowler's hand and wrist. The brace member includes an elongated sheath having open end pockets for receiving the opposite ends of a plurality of spaced-apart rods arranged in spaced-apart relationship. The rods are rigid and may be arranged in parallel or in angled relationship on the sheath with the separating sheath material forming flexible areas permitting the brace member to flex laterally along its length or about its longitudinal axis as viewed from the end of the brace member. Therefore, the user's hand and wrist are rigidly supported which aids the bowler in delivering a bowling ball down a bowling alley.

6 Claims, 2 Drawing Sheets

BOWLER'S WRIST BRACE

BACKGROUND OF THE INVENTION

1. Field of the Invention

The present invention relates to the field of sports aids and accessories, and more particularly to a novel wrist brace intended to be worn by a bowler, which provides the bowler with rigid longitudinal support while permitting lateral or transverse flexibility during the tossing or delivering of a bowling ball down a bowling alley.

2. Brief Description of the Prior Art

In the past, a variety of gloves and hand supports have been used in the game of bowling intended to support the bowler's hand or wrist while the bowling ball is being delivered towards a pattern of pins. The conventional gloves or supports are designed to be used on either the left or right hand of the user and are not interchangeable between the hands. Such a prior art support is disclosed in U.S. Letters Design Pat. No. D-288,372. Such a glove or support is not flexible and will not conform to the user's hand during the course of play. The support element employed is entirely rigid in both its longitudinal and transverse axes and because of the specific design for right or left-handed persons, the support for the rigid member is not adapted to be interchanged and, therefore, a manufacturer must make two different categories of gloves or braces so that both right and left-handed persons can be accommodated.

Therefore, a long-standing need has existed to provide a brace for a bowler's hand and/or wrist which may be worn on either the right or the left hand of the bowler and which will permit lateral flexure of the rigid support member while preventing longitudal bending or flexure when the brace is worn by the user.

SUMMARY OF THE INVENTION

Accordingly, the above problems and difficulties are avoided by the present invention which provides a novel bowler's wrist brace or support which includes an elongated base having a cushion portion providing comfort to a bowler whether the brace is worn on the left or the right hand. An elongated brace member is carried on the base in engagement with the back of the user's wrist and hand so as to prevent flexure of the wrist during the tossing or throwing of a ball during a game. The brace member is provided with an elongated rigid member which permit lateral flexure while preventing longitudinal bending or flexure. In one form of the invention, the brace member includes a plurality of elongated rods which are arranged in spaced-apart relationship in either parallel relationship or fanned arrangement or other angular relationship. The areas of the base member separating the adjacent ones of the rods permit flexure about the sides, such as when the aid or device is being worn by the user. However, the rigidity of the elongated rods prevents longitudinal flexure so that the user's wrist maintains the hand in an unmovable position. However, the user's fingers remain free for movement.

Straps integral with the base are wrapped about the wrist of the user as well as the finger portions so as to maintain the aid in position on the back of the hand and wrist of the user and hook and pile fastening means are employed for detachably connecting the straps to the base so as to maintain the rigid brace member position against the back of the user's hand and wrist.

Therefore, it is among the primary objects of the present invention to provide a bowler's glove or brace which prevents longitudinal bending while permitting lateral flexure when the aid is releasably attached to the back of the user's hand and wrist.

Yet another object of the present invention is to provide a novel bowler's hand and wrist support which may be employed interchangeably for right or left-handed persons.

Another object of the present invention is to provide a single hand and wrist support which includes straps that may be wrapped about the hand and wrist of the user so that either right or left-handed persons may use the aid while engaging in the game of bowling.

Still another object of the present invention is to provide a hand and wrist brace for bowlers which includes straps for releasably holding the aid onto the user's hand and wrist which applies a pulling force towards the body of the user so as to hold the brace in place at the start of a procedure to fasten straps about the hand and wrist of the user.

Still another object of the present invention is to provide a wrist/hand support aid for bowlers which incorporates a plurality of rods arranged in fixed spaced-apart relationship and having opposite ends of the rods retained in pouches on a brace member so that the member shapes itself to the user's hand and wrist whereby the support or aid gains its supporting strength.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
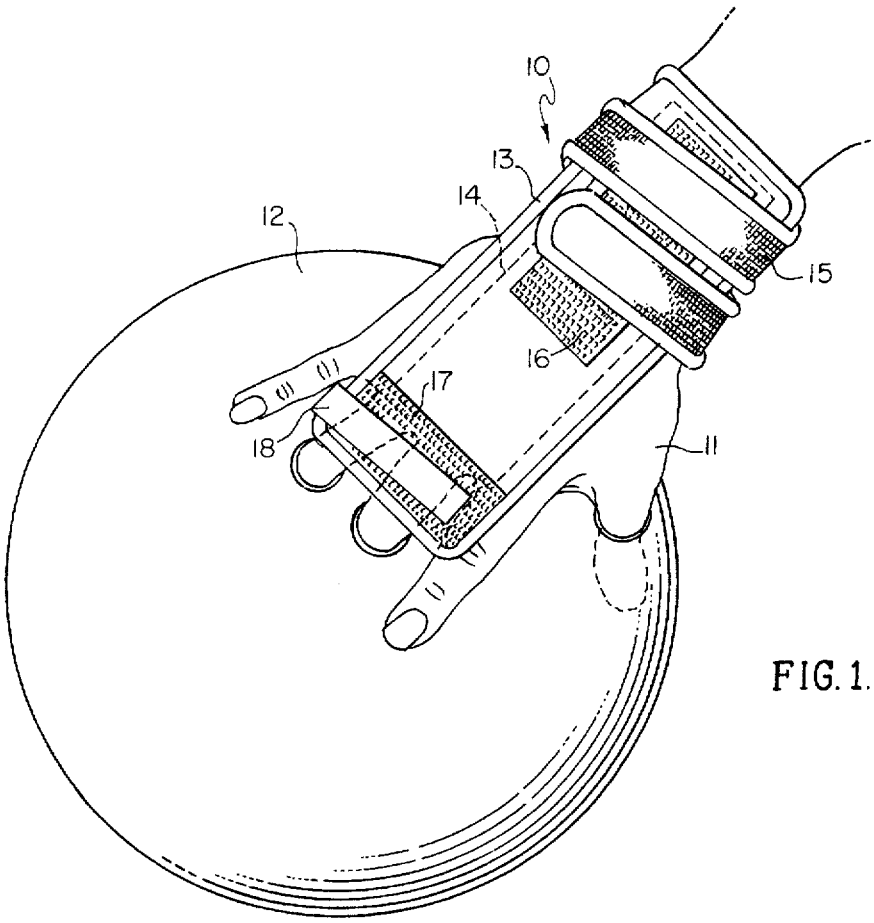
FIG. 1 is a top view of the wrist/hand support aid for bowlers incorporating the present invention and illustrated in connection with the delivery of tossing of a bowling ball.

Referring to FIG. 1, the novel wrist/hand brace of the present invention is illustrated in the general direction of arrow 10 and is illustrated in connection with the hand of a user illustrated by numeral 11 with the fingers of the hand inserted into respective holes in a bowling ball 12. The brace 10 includes a base 13 covering an elongated brace member 14 illustrated in broken lines. The longitudinal length of the brace member 14 extends from the back of the wrist of the user to the back of the hand terminating in an area about the joints of the fingers with the hand. The base 13 includes a wrist strap 15 which encircles the wrist and the back end of the base and terminates in a hook and pile fastening arrangement of which pile component 16 is carried on the exposed rear or back end of the base. The forward end of the base includes a hook and pile component 17 which detachably connects with the end of a finger strap represented by numeral 18. Therefore, when the wrist brace is worn by the user, bending between the hand is prevented by the rigid brace member 14. The straps 15 and 18 releasably and detachably secure the brace to the wrist and back of the hand of the user.

Figure 2:
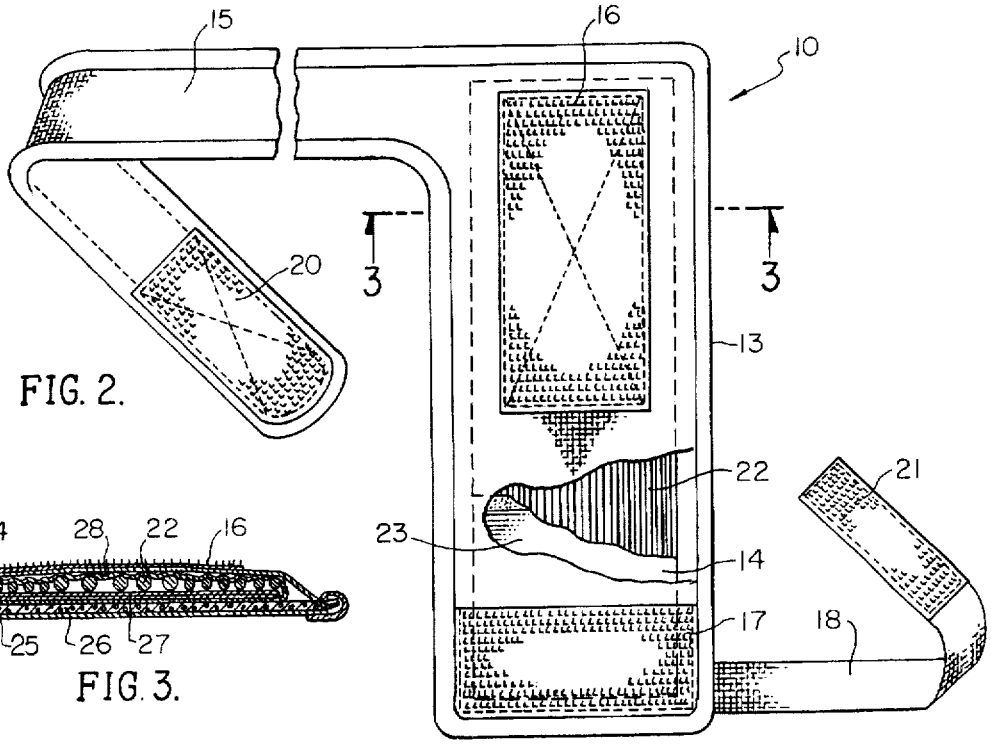
FIG. 2 is a top perspective view of the novel wrist/hand support aid shown in FIG. 1.
Figure 3:
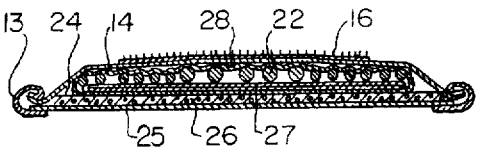
FIG. 3 is a transverse cross-sectional view of the aid shown in FIG. 2 as taken in the direction of arrows 3—3 thereof.

Referring now in detail to FIGS. 2 and 3, it can be seen that the terminating free ends of the straps 15 and 18 respectively include an additional hook and pile component 20 and 21 which detachably connect with the components 16 and 17 respectively. Also, it is noted that the wraps for the straps are alternate since the strap 15 will be wrapped about the wrist of the user in a double encirclement from one side of the base 13 while the finger strap 18 wraps from the opposite side of the base 13 about the middle fingers of the user. The brace member 14 includes a plurality of elongated rigid rods, such as rod 22, arranged in an assembly and which includes opposite ends that are tucked into pockets such as a pocket 23 carried at one end of a sheet or sleeve. The construction and variations of the brace member 14 are more clearly described with respect to FIGS. 4–7 inclusive.

Referring now in detail to FIG. 3, it can be seen that the base 13 forms a sleeve having an internal compartment 24 in which the brace member 14 is disposed. The base member includes a lower or under fiber or fabric sheet 25 which includes a cushioned or padded layer 26 for the comfort of the user. The brace member 14 includes an under layer or sheet 27 with an upper layer or sheet 28 which in FIG. 3, represents a pocket for receiving the ends of the rods 22 opposite from the pocket 23 shown in FIG. 2. It is to be particularly noticed that the plurality of elongated rigid rods 22 are separated from one another and that this permits the brace member to be flexed about the longitudinal central axis of the member. In other words, flexure may occur laterally or transversely of the central longitudinal axis since there is no rigid support in a lateral or transverse direction. However, it is also to be noted that the brace member prevents bending of the hand with respect to the wrist which may be referred to as a longitudinal direction with respect to the length of the brace member.

Figure 4:
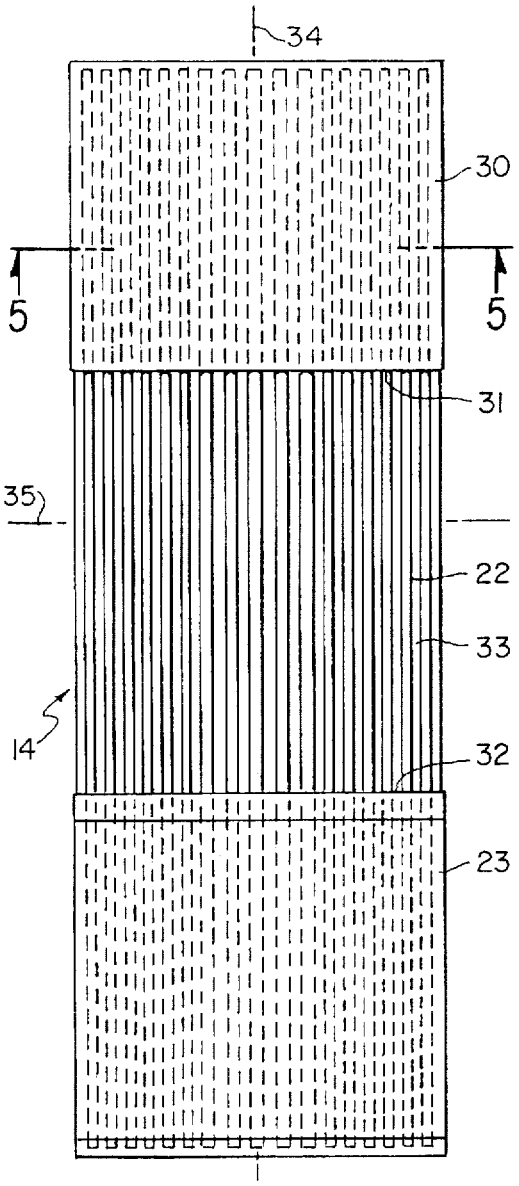
FIG. 4 is an enlarged top view of a brace member incorporated into the aid shown in FIG. 2.
Figure 5:
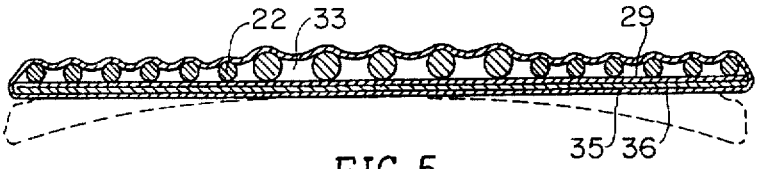
FIG. 5 is a transverse cross-sectional view taken in the direction of arrows 5—5 of FIG. 4.

Referring in detail to FIGS. 4 and 5, the brace member 14 is illustrated wherein a holder for the plurality of rigid rods is defined as having a length of flexible material 29 which is folded over upon itself at each end so as to provide pockets 23 and 30 respectively. The pockets are open-ended as represented by numerals 31 and 32 so that the pockets are arranged in fixed spaced-apart relationship and the rods 22 may be exposed in this central area. It is again particularly to be noticed that the rods are in spaced-apart relationship and are separated by material of the layer 29 and the separation is identified by numeral 33. Therefore, it can be seen that a plurality of separation areas 33 are provided between adjacent ones of the plurality of rods 22 and that these separation areas may be considered similar to a hinge or flexible portions so that the plurality of rods may be flexed about a central longitudinal axis represented by numeral 34, while the brace member cannot be flexed laterally or along a transverse axis, such as represented by numeral 35. The bending or flexing in a lateral or transverse direction is illustrated in broken lines in FIG. 5. Also, if desired, an additional layer of material 36 can be provided between the sheet or layer 29 and an underlying layer 36. In FIG. 4, the plurality of rigid rods are arranged in parallel spaced-apart relationship.

Figure 6:
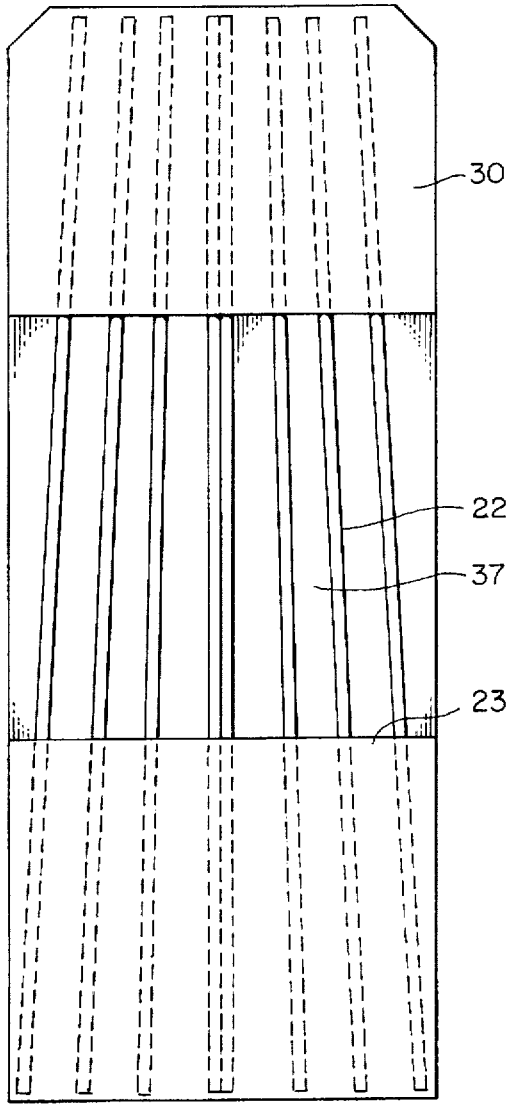
FIG. 6 is an enlarged top plan view of another embodiment for a brace member.

Referring now in detail to FIG. 6, a different version of brace member is illustrated in which the plurality of rods are arranged in an angular or fanned-out position. The ends of the rods, such as rod 22, are arranged close together within pocket 30 while the opposite ends are fanned radially and covered by pocket 23. The rods arranged in this pattern greatly reduce the number of rods needed to give rigidity and the flexing of the brace member in a lateral or transverse direction, as previously described, is permitted since the flex areas between adjacent rods are substantially wider and of greater area. Such a flex area is indicated by numeral 37.

Figure 7:
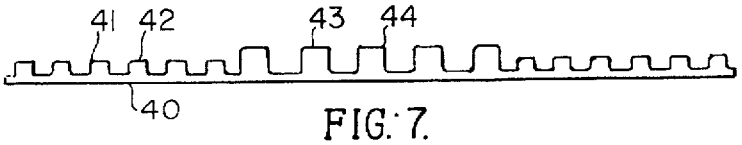
FIG. 7 is an end view of a brace member illustrating another embodiment.

Still another version of brace member is illustrated in FIG. 7 in which the member is composed of a single unitary construction composed of a plastic or plastic-like material which includes a sheet 40 having a plurality of ribs integrally formed therewith. Certain ribs can be of the same height, such as represented by ribs 41 and 42, while central ribs 43 and 44 may be of a greater height. The ribs are longitudinal in a similar manner as the rods 22 and therefore prevent flexing anywhere along the longitudinal length but permitting lateral or transverse flexing about the ribs 43 and 44 which are of greater material density. The embodiment shown in FIG. 7 may be incorporated on the base holder 13 in a suitable manner, such as employing pockets, adhesives or other fastening means.

In view of the foregoing, it can be seen that the hand/wrist brace of the present invention differs from other support concepts in that instead of employing a stamped and/or shaped piece of aluminum or rigid sheet steel, the present invention employs the concept of rib construction taking the form of integral ribs as shown in FIG. 7 or a plurality of spaced-apart rods, as shown in the other figures. The rods or ribs are provided in a series which runs the length of the member so as to give strength but allowing flexure about the central longitudinal axis but not allowing for flexure about a transverse axis. The series of rods may be composed of music wire, carbon fiber and/or fiberglass plastic rods which are secured to the backing material that may be composed of either vinyl, thin flexible plastic sheeting or some other suitable material, and can be held together by means of a double adhesive tape. The rods may vary in diameter anywhere from one-eighth inch to one-sixteenth inch and in length from five inches to ten inches.

Rather than being placed in a side-by-side relationship, the rods may be spaced in varying amounts, such as shown in FIG. 6. The backing material to which the rods are secured is placed in a pocket or pouch at opposite ends of a sleeve or sheeting which is then attached to the wrist/hand base by appropriately placed straps, preferably at each end of the base. Because the rods are spaced-apart, the pouch shapes itself to the user's hand and wrist and it is from this that the unit gains its supporting strength. The sides of the device or brace member are straight for both right and left-handed persons and the device may be worn by either right or left-handed persons. If desired, the straps may be composed of an elastic material so as to provide a yieldable tightening force to hold the device in place on a user's wrist and at the front of the hand where the fingers join therewith. The brace member may be placed immediately under the base followed by retention of the brace member in place when the straps are connected. However, it is to be understood that the base member may include a sleeve or compartment into which the brace member can be slid so that a single construction is provided. An example of this construction is shown in FIG. 3.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A wrist and hand brace for bowlers comprising:

an elongated base having opposite ends;

strap means carried on said base opposite ends adapted to wrap around the wrist and middle fingers of the user;

an elongated rigid brace member disposed between said base and the wrist and hand of the user;

said rigid brace member having a plurality of rigid non-bendable elements arranged in spaced-apart relationship along the length of said brace member;

said brace member characterized as being flexible about a central longitudinal axis of said elongated brace member;

said brace includes flexible areas between and separating adjacent ones of said rigid brace member to permit bending of said brace member laterally of said central longitudinal axis whereby said brace member form fits to the back of the user's wrist and hand;

said rigid elements are elongated rods; and said elongated rigid rods are in a radial pattern fanning outwardly from the location of the wrist towards the fingers of the hand.

2. The wrist brace as defined in claim 1 wherein:

said brace member includes a sheet of flexible material having said elongated rigid rods secured thereon; and open-ended pockets on each end of said sheet for receiving and retaining the opposite ends of said plurality of rigid rods.

3. A wrist and hand brace for bowlers comprising:

an elongated base having opposite ends;

strap means carried on said base opposite ends adapted to wrap around the wrist and middle fingers of the user;

an elongated rigid brace member disposed between said base and the wrist and hand of the user;

said rigid brace member having a plurality of rigid non-bendable elements arranged in spaced-apart relationship along the length of said brace member;

said brace member characterized as being flexible about a central longitudinal axis of said elongated brace member;

said brace includes flexible areas between and separating adjacent ones of said rigid brace member to permit bending of said brace member laterally of said central longitudinal axis whereby said brace member form fits to the back of the user's wrist and hand;

said brace member is a unitary construction having a base with a plurality of ribs forming said elongated rigid elements; and flexible areas between said ribs permitting lateral bending of said brace member about said central longitudinal axis.

4. The wrist brace as defined in claim 3 wherein:

said base includes a foam cushion separating said brace member from the user's wrist and hand.

5. The wrist brace as defined in claim 1 wherein:

said base and said brace member are adapted to be worn by right or left-handed users.

6. The wrist brace as defined in claim 3 wherein:

said strap means includes hook and pile fasteners to effect detachable closure; and one strap of said strap means attached to a selected side of said base and the other strap of said strap means attached to a non-selected side of said base.

* * * * *